US005927600A

United States Patent [19]

Collin et al.

[11] Patent Number: 5,927,600

[45] Date of Patent: Jul. 27, 1999

[54] RAIL CAP

[76] Inventors: Gilbert Collin, 599 Sandford Street, Newmarket Ontario, Canada, L3X 1T4; Michael Nicholson, 17 Amelia Street, Alton, Canada, L0N 1A0

[21] Appl. No.: 08/786,122

[22] Filed: Jan. 17, 1997

[51] Int. Cl.[6] ..... E01B 11/02

[52] U.S. Cl. ..... 238/218; 238/225

[58] Field of Search ..... 238/218, 219, 238/224, 225, 226, 227

[56] References Cited

U.S. PATENT DOCUMENTS 5,024,380 6/1991 Newman ..... 238/225
5,090,618 2/1992 Newton ..... 238/225

FOREIGN PATENT DOCUMENTS 22055 3/1921 France ..... 238/218
263906 4/1929 Italy ..... 238/219

*Primary Examiner*—S. Joseph Morano
*Attorney, Agent, or Firm*—Rogers & Milne

[57] ABSTRACT

A rail cap for spanning a gap between two longitudinally adjacent rail sections. The rail cap includes a downwardly opening channel member mountable over the top of the rail sections across the gap. A lower clamping member is insertable beneath each rail section and securable to the channel member. A lateral restraint is provided for preventing the channel from moving toward the inside of the track. A longitudinal restraint is provided which interacts with the channel member and the ends of the gap between the rail sections to prevent longitudinal movement of the rail cap. A guide block is provided along an outer leg of the channel member to guide an inner flange of a wheel away from an inner leg of the channel member.

7 Claims, 4 Drawing Sheets

RAIL CAP

FIELD OF THE INVENTION

This invention generally relates to railroad tracks and more specifically to structures for temporarily spanning gaps in a rail.

BACKGROUND OF THE INVENTION

Rails, like most structures changes dimensionally in response to heat; expanding when heated and contracting when cooled. For many years, rails were joined end to end by splice bars spanning the joint and bolts extending transversely through the splice bars and the rail. The presence of such joints allowed for thermally induced lengthening and shortening of the rail to be accommodated by corresponding narrowing or widening of a gap between the rail ends on opposite sides of the joint. The gap is what gives rise to the "clackety-clack" sound often associated with rail travel which occurs when the wheelsets of the train cross the gap.

More recently, it has become a common practice to weld the adjoining ends of adjacent rail sections together using electrical or thermite welding techniques. This produces a stronger joint and a quieter track than the prior splice bar and bolt joints. Welded rail however has significantly longer sections between expansion joints than bolted rail (often several miles) and accordingly is subject to significantly greater stresses arising from thermal expansion and contraction.

Thermal stresses generally cause more problems in cold weather than in hot weather. When longitudinal expansion occurs, it is generally accommodated by elastic deformation longitudinally and possibly some lateral flexion of the rails. In contrast, contraction can only be accommodated by elastic deformation which often causes failure at any weaker areas, such as weld joints or defects in the rail. Weld joints are particularly susceptible to failure because of metallurgical changes in what is sometimes referred to as the "heat affected zone", impurities in the filler material and incorrect weld temperatures.

If a rail separates because of stress induced failure, electrical conductivity along the rail is interrupted giving rise to a signal failure. Should this occur, the location of the break must be located and an assessment made as to whether a train can be safely permitted to cross the break. If the span of break exceeded 2 to 3 inches then, at least before the present invention, a rail repair crew had to be sent out to repair the rail. At a minimum, this caused a delay and traffic problems as it upset the rail scheduling for any trains that had to pass the broken area. It also caused crewing problems if the delay was enough for a crew to exceed the permitted time before re-crewing at a location remote from the scheduled replacement crew.

It is therefore an object of the present invention to provide a structure that can be readily installed to cap a break in the rail to permit trains to pass over the break at least at a reduced speed until a proper repair can be effected thereby minimizing staffing and crewing problems.

It is a further object of the present invention to provide such a structure which can be installed by one person.

It is another object of the present invention to provide such a structure with features that avoid its being displaced longitudinally relative to the break and from being caught by and damaged by a wheel flange.

It is also an object to provide such a structure which will restore a signal that has been interrupted by the break.

SUMMARY OF THE INVENTION

A rail cap for spanning a gap between two longitudinally adjacent rail sections of a railroad track. The rail cap comprises:

a downwardly opening channel member mountable over the top of the adjacent rail sections to span the gap;

a lower clamping member insertable beneath each of the rail sections;

securing means for securing the lower clamping member to the channel member thereby holding the channel member against the top of the rail;

lateral locating means to prevent the channel from moving toward the inside of the rail;

longitudinal locating means securable to the channel member and insertable into the gap to interact with respective ends of the rail sections on either side of the gap to prevent longitudinal movement of the rail cap along the rail sections;

the channel member has an upper surface for supporting the wheel, the upper surface tapering into a ramp at opposite ends thereof to guide the wheel onto and off of the rail cap;

a guide is secured adjacent an outer leg of the channel member, the guide has a flange extending above the upper surface of the channel member, the flange has a guiding face facing across the upper surface and diverging from a longitudinal axis of the rail cap toward the ends of the rail cap, and the guiding face co-operates with an outer face of the wheel to guide an inner flange of the wheel away from an inner leg of the channel member to prevent the flange of the wheel from striking the ends of the inner leg;

the upper surface and the inner leg taper into a ramp at opposite ends to guide the wheel onto and off of the rail cap; and, the guide extends beyond the end of the inner leg at both ends of the rail cap.

DESCRIPTION OF DRAWINGS

The invention is described in more detail below with reference to the accompanying drawings in which.

DESCRIPTION OF PREFERRED EMBODIMENTS

Figure 1:
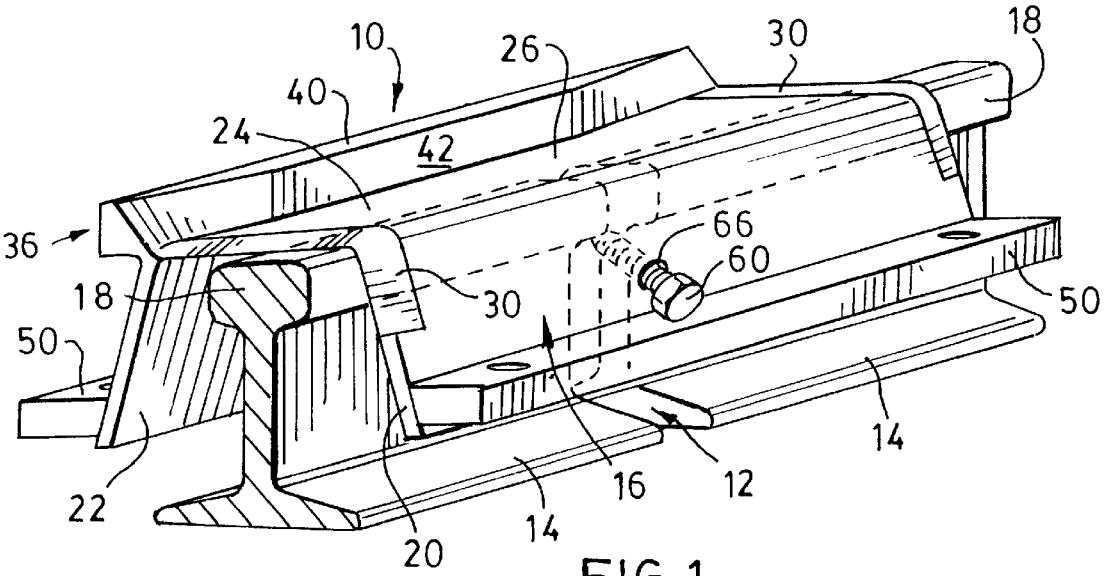
FIG. 1 is a perspective view of a rail cap according to the present invention.

A rail cap according to the present invention is generally indicated by reference 10. The rail cap is illustrated spanning a gap 12 between two longitudinally adjacent rail sections 14.

The rail cap 10 has a downwardly opening channel member 16 which is mountable over and receives respective tops 18 of the rail sections 14. The channel member 16 has an inner leg 20 and an outer leg 22 extending down from opposite sides of a top 24 of the channel member 16. The top 24 has an upper surface 26 for supporting a wheel 28 in FIGS. 2 through 4 as it passes over the rail cap 10.

The upper surface 26 of the top 24 and the adjacent ends of the inner leg 20 taper into a ramp 30 at each end. The ramps 30 guide the wheel 28 up onto the upper surface 26 to ease the transition of the wheel from the top 18 of the rail section 14 onto the upper surface 26 of the channel member 16 and back down from the upper surface onto the top 18 of the adjacent rail section 14. The presence of the ramps 30 minimizes the tendency of the wheel 28 to push the rail cap 10 along the rail section 14.

Figure 2:
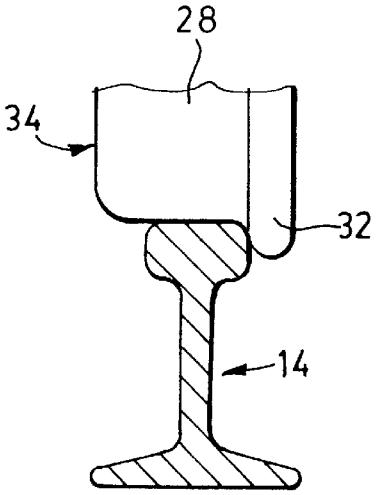
FIG. 2 is an end view illustrating a wheel on a normal rail.
Figure 3:
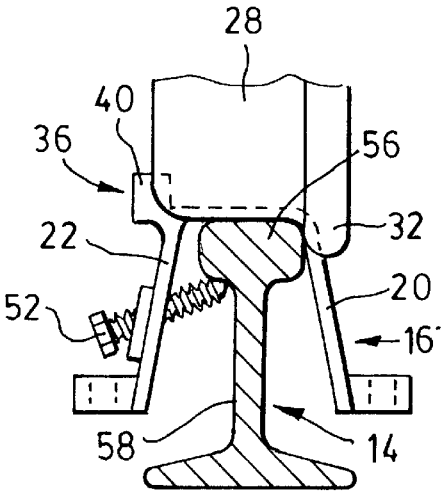
FIG. 3 is an end view showing a wheel approaching a rail cap according to the present invention.

FIG. 2 illustrates a wheel 28 as it normally sits on a rail section. The wheel 28 has a flange 32 toward what is referred to as the "gauge side" of the rail (ie; toward the inside of the track) and an outer face 34 toward the "field side" of the rail (ie; the outside of the track). FIG. 3 illustrates the wheel 28 as it approaches the rail cap 10. As shown in FIG. 3, the flange 32 must be guided to the right in order to avoid striking the end of the inner leg 20. In order to urge or guide the wheel 28 away from the inner leg 20, a guide 36 is provided. The guide 36 is secured adjacent to the outer leg 22 of the channel member 16, for example by welding or bolting.

The guide 36 has a flange 40 which extends above the upper surface 26 of the top 24 of the channel member 16. The flange has a guiding face 42 facing across the upper surface 26. The guiding face 42 of the guide 36 diverges away from a longitudinal axis 44 of the rail cap 10 toward the ends of the channel member 16. In other words, the guiding face 42 is further from the longitudinal axis 44 at the ends of the rail cap 10 than it is further along the rail cap 10.

Figure 4:
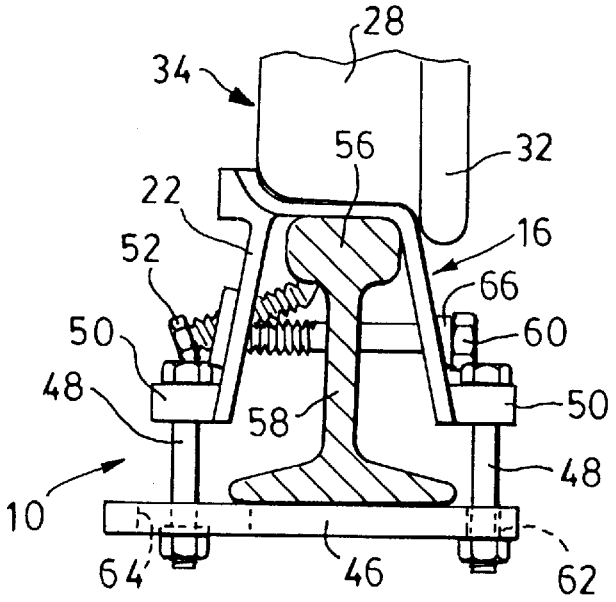
FIG. 4 is an end view showing a wheel on a rail cap according to the present invention.

As shown in FIGS. 3 and 4, as the wheel 28 approaches the rail cap 10, the guiding face 42 of the guide 38 presses against the outer face 34 of the wheel 28 and cooperates with the outer face 34 to guide the wheel to the right as illustrated thereby guiding the inner flange 32 of the wheel 28 inwardly (to the right as illustrated) away from the end of the inner leg 20. This prevents the flange 32 of the wheel 28 from striking the end of the inner leg 20.

Figure 6:
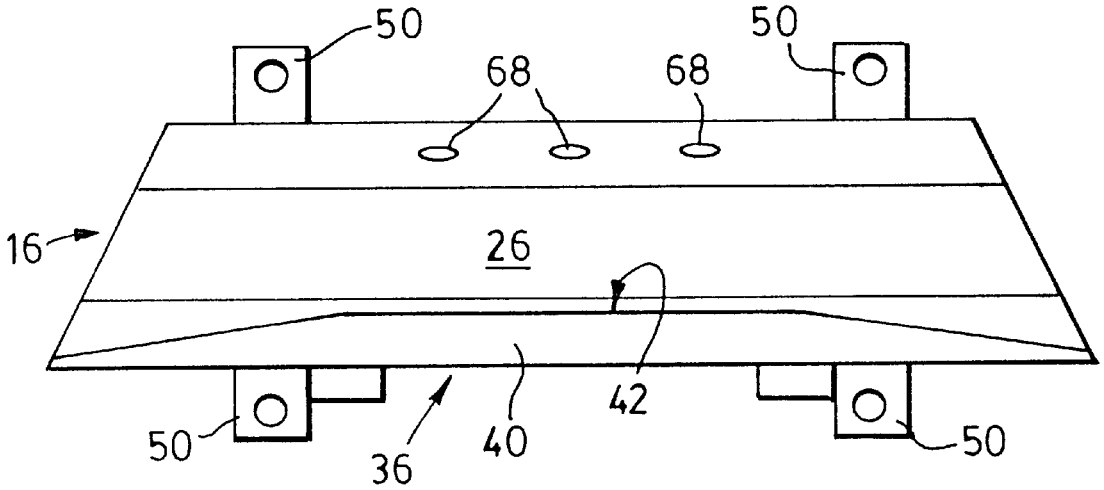
FIG. 6 is a top plan view of a channel member and guide of a rail cap according to the present invention.

To ensure that the wheel 28 contacts the guide 36 before it contacts the inner leg 20, the ends of the rail cap 10 are angled so that the guide 36 extends beyond the inner leg 20 at both ends of the rail cap 19, as can best be seen in FIG. 6.

Secure mounting of the rail cap 10 requires that the rail cap 10 be held firmly against the top 18 of the rail sections 14, restrained from moving to the inside or "gauge side" of the rail (ie; to the right as illustrated) and restrained from moving along the rail sections 14.

Figure 5:
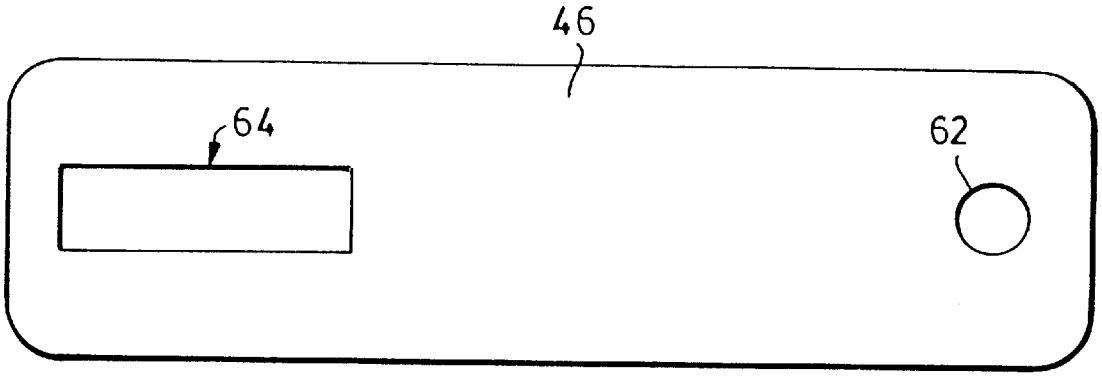
FIG. 5 is a top plan view of a lower clamping member according to the present invention.
Figure 7:
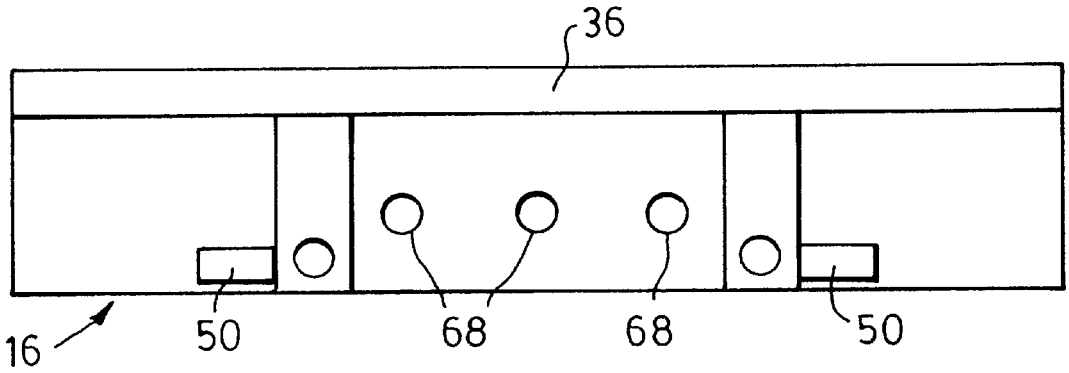
FIG. 7 is a front elevation of a channel member and guide of a rail cap according to the present invention.
Figure 8:
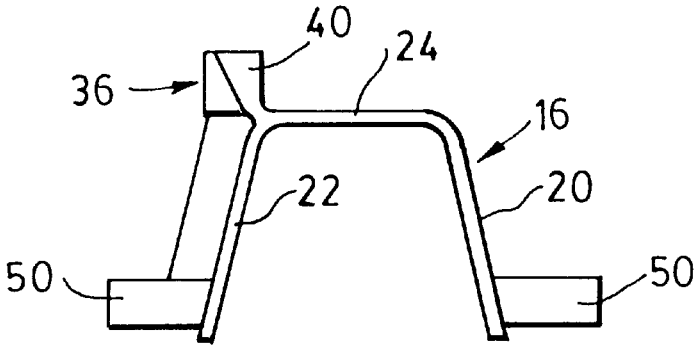
FIG. 8 is an end elevation of a channel member and guide of a rail cap according to the present invention.

The rail cap 10 is held to the top 18 of the rail sections 14 by a lower clamping member 46. A suitable lower clamping member 46 is illustrated in FIG. 5 as a generally rectangular plate which can be inserted below the rail sections 14. In practise, this may require a bit of digging to ensure adequate space for insertion. Securing means such as bolts 48 secure the lower clamping member 46 to the channel member 16. Outwardly extending flanges 50 may be provided along respective lower edges of the inner leg 20 and outer leg 22. Although continuous flanges 50 are illustrated in FIG. 1, this is not necessary as separate flanges or tabs may be provided for each lower clamping member 46 as illustrated in FIGS. 6 and 7.

The lower clamping member may have a threaded hole 62 toward one end and an elongate hole or slot 64 toward the opposite end. Although threaded holes may be provided at both ends, the use of a slot 64 eases installation by allowing for greater manufacturing tolerances in the breadth of the channel member 16, and also allows for re-use of the rail cap 10 which may be slightly deformed after a first use. The slot 64 is preferably used in association with a nut that interacts with the slot 64 to prevent rotation thereby eliminating the need for a second wrench to hold the nut while the retaining bolts 48 are tightened.

The rail cap 10 is prevented from moving inwardly by lateral locating means such as bolts 52 threaded through the outer leg 22. The bolts 52 are inclined upwardly to nest with (engage) a juncture 54 between the underside of a rail head 56 and an adjoining web 58 of the rail sections 14. Tightening of the bolts 52 will cause the channel member 16 to be urged downwardly and outwardly (ie; to the left or "field side" as illustrated).

Longitudinal locating means are provided to prevent the rail cap 10 from moving along the rail sections 14. The longitudinal locating means illustrated consists of a bolt 60 which extends through the inner leg 20 and outer leg 22 of the channel member 16. The bolt is inserted through the gap 12 between the rail sections 14 and interacts with the ends of the rail sections 14 on either side of the gap 12 to prevent longitudinal movement of the rail cap 10 along the rail sections 14. Although a bolt 60 is illustrated, other longitudinal restraining means may work, such as a tab or web (not illustrated) extending across the inside of the channel member 16 through the gap 12.

As the inner leg 20 and outer leg 22 diverge downwardly from each other, a bevelled washer 66 may be used at both ends of the bolt 60 to reduce any bending of the bolt 60 that would otherwise be caused by the inclined nature of the inner leg 20 and outer leg 22.

Preferably, the rail cap 10 should be light enough to be carried and installed by one person. Accordingly, the desired weight absent the bolts and lower clamping members should not exceed 50 pounds. The rail cap 10 nevertheless has to be strong enough to support the weight carried by each wheel 28. The rail cap 10 may also be electrically conductive to restore the signal once installed. The rail cap may be made from a metal consisting essentially of magnesium. In applications where weight is of less concern, steel or cast iron could be used. Suitable results have been observed using T1 steel plate for the channel member 16 and T4 steel plate for the guide 36 with the guide 36 welded to the channel member 16.

Preferably, the breadth of the channel member 16 and the height of the inner leg 20 and outer leg 22 will be selected to accommodate different rail sizes and "overflow". Overflow is a broadening of the head of the rail resulting from deformation by wheels 28 passing over the rail.

Figure 11:
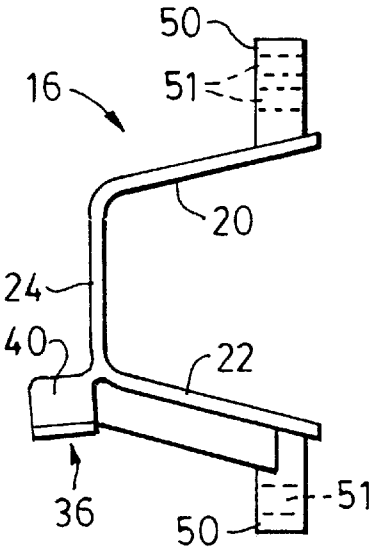
FIG. 11 is an end elevation of a channel member and guide of an alternate embodiment of a rail cap according to the present invention.
Figure 9:
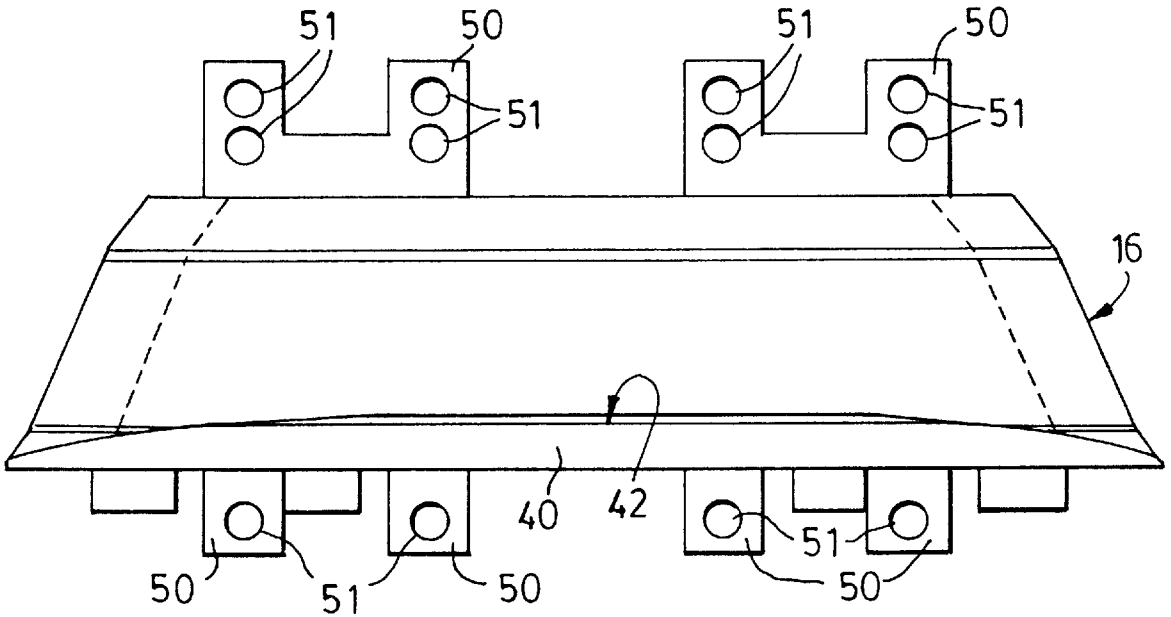
FIG. 9 is a top plan view of a channel member and guide of an alternate embodiment of a rail cap according to the present invention.
Figure 10:
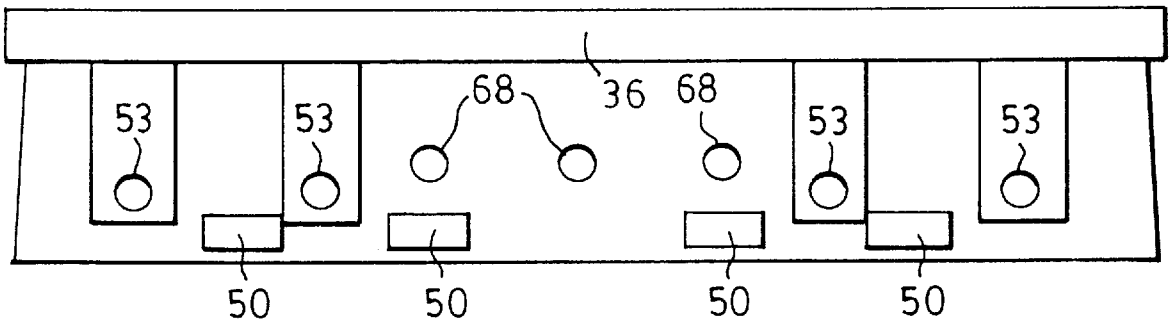
FIG. 10 is a front elevation of a channel member and guide of an alternate embodiment of a rail cap according to the present invention.

FIGS. 9, 10 and 11 illustrate an alternate embodiment of a rail cap according to the present invention. The alternate embodiment is similar in many respects to the embodiment described above and accordingly like reference numberals are used to indicate similar components. In the alternate embodiment additional flanges 50 are provided as are additional holes 51 through the flanges 50 for receiving bolts 48. Also additional threaded openings 53 are provided for receiving locating means such as bolts 52. The additional tabs or flanges 50 and additional bolt holes 51 and 53 provide alternate mounting points to ensure that the rail cap 16 can be securely mounted without interference from rail ties and to avoid gap 12 regardless of the location of the gap 12, rail tie spacing and location.

The above description is intended in an illustrative rather than a restrictive sense. Variations may be apparent to those skilled in the art without deviating from the spirit and scope of the invention as defined in the claims below.

For example, testing has indicated that if the rail cap 10 is securely bolted, it may be possible to omit the bolt 60 in which case the lower clamping members 46, the associated securing means or bolts 48 and the lateral locating means would comprise the longitudinal locating means. Furthermore, as illustrated in FIGS. 6 and 7, several holes 68 may be provided through the inner leg 20 and outer leg 22 for the bolt 60 to ensure that the bolt 60 can extend through the gap 12 regardless of interference between railroad ties and the lower clamping members 46. The rail cap 10 may also be used to repair bolted track or to repair rough spots in a rail where a section of the head is broken off, but complete separation of the rail does not occur.

We claim:

1. A rail cap for spanning a gap between two longitudinally adjacent rail sections of a railroad track, said rail cap comprising:

a downwardly opening channel member mountable over the top of said adjacent rail sections to span said gap;

a lower clamping member insertable beneath each said rail section;

securing means for securing said lower clamping member to said channel member to hold said channel member against the top of said rail sections;

lateral locating means for preventing said channel from moving toward the inside of said rail sections;

longitudinal locating means securable to said channel member and insertable into said gap to interact with respective ends of said rail sections on either side of said gap to prevent longitudinal movement of said rail cap along said rail sections;

said channel member having an upper surface for supporting a wheel;

a guide running along and secured adjacent an outer leg of said channel member, said guide having a flange extending above said upper surface of said channel member, said flange having a guiding face facing across said upper surface and diverging from a longitudinal axis of said rail cap toward said ends, said guiding face co-operating with an outer face of said wheel to guide an inner flange of said wheel away from an inner leg of said channel member to prevent said flange of said wheel from striking said ends of said inner leg;

said upper surface and said inner leg taper into a ramp at opposite ends thereof to guide said wheel onto and off of said rail cap; and, said guide extends beyond said inner leg at both ends of said rail cap.

2. A rail cap as claimed in claim 1 wherein:

said channel member has outwardly extending flanges along respective lower ends of said inner and outer legs;

said securing means for securing said lower clamping member are bolts extending between said lower clamping member and said outwardly extending flanges;

said lateral locating means are bolts threaded through said outer leg and inclined upwardly toward a top of said channel member for engaging said rail sections at a juncture between an upper rail head and a web of said rail section; and, said longitudinal locating means is a bolt extending through said inner and outer legs and said gap between said adjacent rail sections.

3. A rail cap as claimed in claim 2 wherein said guide is welded to said outer leg and said channel member and said guide are made from a metal consisting essentially of magnesium.

4. A rail cap as claimed in claim 2 wherein said guide is welded to said outer leg and said channel member and said guide are made from steel plate.

5. A rail cap as claimed in claim 4 wherein said lower clamping member has a threaded hole for receiving a first of said bolts, a slot for receiving a second of said bolts, a nut for securing said second bolt and said slot and said nut interact to prevent rotation of said nut during tightening of said second bolt.

6. A rail cap as claimed in claim 1 wherein at least said channel member is manufactured from a metal consisting essentially of magnesium.

7. A rail cap as claimed in claim 1 wherein said channel member and said guide are manufactured from steel plate.

* * * * *